US005755547A

United States Patent [19]

Flerchinger et al.

[11] Patent Number: 5,755,547

[45] Date of Patent: May 26, 1998

[54] SIDE LOADING REFUSE COLLECTION VEHICLE ARM RESTRAINT

[75] Inventors: Gary G. Flerchinger, Hixson, Tenn.; Wayne C. Smith, Payne, Ala.

[73] Assignee: The Heil Company, Chattanooga, Tenn.

[21] Appl. No.: 661,197

[22] Filed: Jun. 10, 1996

[51] Int. Cl.[6] ..... B65F 3/02

[52] U.S. Cl. ..... 414/408; 414/549

[58] Field of Search ..... 414/406, 408, 414/422, 424, 549, 555, 645; 212/292

[56] References Cited

U.S. PATENT DOCUMENTS

| | | | |
|---|---|---|---|
| 3,502,228 | 3/1970 | Tamborino | 212/292 |
| 3,521,768 | 7/1970 | Rohwedder | 414/523 |
| 3,786,949 | 1/1974 | Sutton | 414/424 X |
| 3,796,331 | 3/1974 | Dutton | 414/555 X |
| 4,036,372 | 7/1977 | Rao et al. | 212/292 X |
| 4,726,726 | 2/1988 | Dossena et al. | 414/549 X |
| 5,026,104 | 6/1991 | Pickrell | 414/406 X |
| 5,360,310 | 11/1994 | Jones et al. | 414/422 X |

*Primary Examiner*—James W. Keenan
*Attorney, Agent, or Firm*—Alan Ruderman

[57] ABSTRACT

A side loading refuse collection vehicle having a carriage slidably mounted on a track and pivotally carrying a lift arm assembly including refuse container grabbing and dumping apparatus for grabbing a refuse container, lifting it and dumping it into the body of the vehicle includes a keeper plate secured to the carriage and a detent latch pivotally mounted on the frame for seizing and holding the keeper selectively. The carriage is slidably driven by a hydraulic cylinder assembly to extend and retract the carriage relative to the vehicle, and whenever the hydraulic cylinder assembly is actuated by an operator control switch the latch disengages from the keeper. When the hydraulic cylinder assembly is not actuated, the latch engages and holds the keeper and thereby prevents the lift arm from being flung outwardly in the event of a failure in the hydraulic cylinder assembly system.

16 Claims, 3 Drawing Sheets

SIDE LOADING REFUSE COLLECTION VEHICLE ARM RESTRAINT

BACKGROUND OF THE INVENTION

This invention relates to refuse collection vehicles of the type having an arm extendible from the body of the vehicle and having a refuse container grabber arm at the end for grasping, lifting and dumping a container into the vehicle, and more particularly to apparatus for preventing the arm from extending away from the vehicle beyond a safe distance in the event of a failure in the arm extension drive system.

Refuse collection vehicles are known which have an arm selectively extendible from the body of the vehicle and having grabbing or grasping apparatus at the end of the arm remote from the vehicle for clamping firmly about a refuse container. Associated with the arm is means for lifting the end of the arm including the grasping apparatus and means for dumping the container into a hopper at the top of the vehicle body. Such vehicles, known in the art as side loaders, have the obvious advantage in that only one person, to wit, a driver is necessary to collect refuse from a substantial number of dwellings or the like. The means for extending the arm includes an elongated hydraulic cylinder with an extendible piston rod which permits the arm to be extended up to approximately 8 feet from the body so that a refuse container may be picked up in tight or difficult locations such as on the sidewalk of a street while the refuse vehicle may be prevented from getting close to the sidewalk because of parked vehicles and the like. The arm may be retracted fully so that the grasping apparatus is disposed substantially within the lateral confines of the body of the vehicle or in close proximity thereto thereby permitting the vehicle to be driven at highway speeds when necessary, such as when traveling to a dump site or the like. The arm may also be positioned between these extremes, such as when the vehicle is driven at relatively slow speeds between adjacent refuse containing stations, e.g. between adjacent dwellings having refuse containers, and when the vehicle turns a street corner between such adjacent dwellings.

A potential problem associated with the extendible lift arm is that which may occur should there be a failure of the arm extension drive means, e.g. the extension cylinder, the hydraulic circuit therefor or the electrical circuit controlling the operation of the hydraulic system. In such a situation the vehicle may be stopped by the driver of the vehicle if the arm is extended far enough from the vehicle to be seen from the cab by the driver. However, if the arm is not extended far enough so as to be viewable by the driver, the driver may not be aware of such a failure and may drive the vehicle at speeds or conditions that would be hazardous to life and property. For example, the arm may spring outwardly due to centrifugal force while the driver is turning a corner or driving at less than relatively high speeds on a street or at high speeds on a highway. Should the arm extend in this manner to its full length an obviously dangerous situation is presented.

SUMMARY OF THE INVENTION

Consequently, it is a primary object of the present invention to provide apparatus which precludes the extendible lift arm of a side loader refuse collection vehicle from extending beyond a desired amount from the body of the vehicle should a failure of the arm extension drive system occur.

It is another object of the present invention to provide latching apparatus for preventing extension of the extendible lift arm of a side loader refuse collection vehicle unless the latching apparatus is disengaged, such disengagement being only at the control of the driver of the vehicle.

It is a farther object of the present invention to provide latching apparatus for locking the extendible lift arm of a side loader refuse collection vehicle in selective retracted positions relative to its fully extended position so as to prevent the arm from extending outwardly haphazardly should a failure of the arm extension drive system occur.

Accordingly, the present invention provides a side loader refuse collection vehicle having an extendible lift arm carrying at the end thereof refuse container grasping apparatus for grasping a refuse container, the arm being extendible by operator controlled drive means, and the arm having latching means associated therewith for locking the arm in selective positions less than the fully extendible position, the latching means being automatically engagable when the arm is extended outwardly, but the latching means being disengaged to permit the arm to be extended outwardly only when the arm is operably driven.

The arm is carried by a slidable carriage driven toward and away from the body of the vehicle and is pivotable relative to the carriage to permit the grasping apparatus to dump a refuse container into the body of the vehicle. The carriage carries a keeper plate which may be seized by a latch or detent when the carriage, and thus the arm, is in preselected positions as the carriage and arm extend outwardly. The detent is pivotally carried on a member fixed relative to the frame of the vehicle and is urged toward seizing disposition with the keeper plate, the detent being selectively pivoted to overcome the urging force to release the keeper plate as the carriage and arm move outwardly. The detent is configured to permit the keeper plate to pivot it into disengaging relationship as the carriage and the arm retract inwardly, but the latch preferably is selectively pivoted to disengagement when the arm is selectively moved inwardly. In the preferred form of the invention, the keeper plate has a number of latch receiving slots and the detent is pivotably moved by a power driven member activated selectively to disengage the detent from the keeper plate when the carriage is driven outwardly and inwardly. Thus, should the carriage driving system fail and the arm urged by centrifugal force or the like outwardly, the detent will be received within a slot and be precluded from extending outwardly further. The disposition of the slots is such that the arm may be precluded from moving beyond approximately 32 inches from the body of the vehicle so that it will not result in a hazardous situation.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
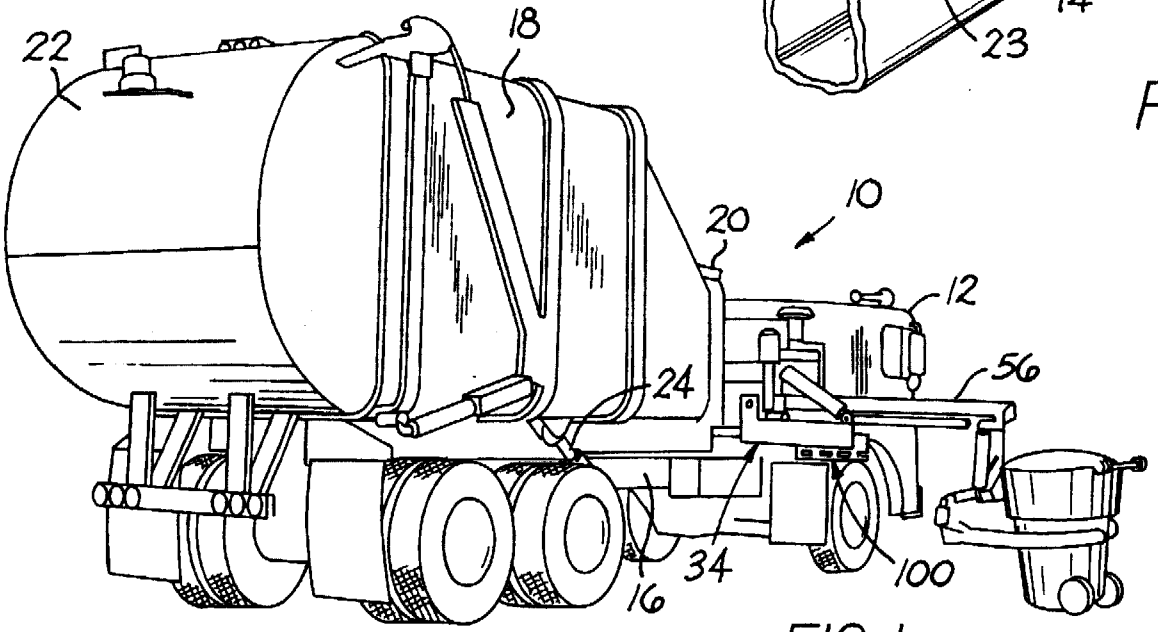
FIG. 1 is a rear perspective view of a side loader refuse collection vehicle illustrated with the lifting arm substantially fully extended and with the grasping apparatus clamped about a refuse container.
Figure 2:
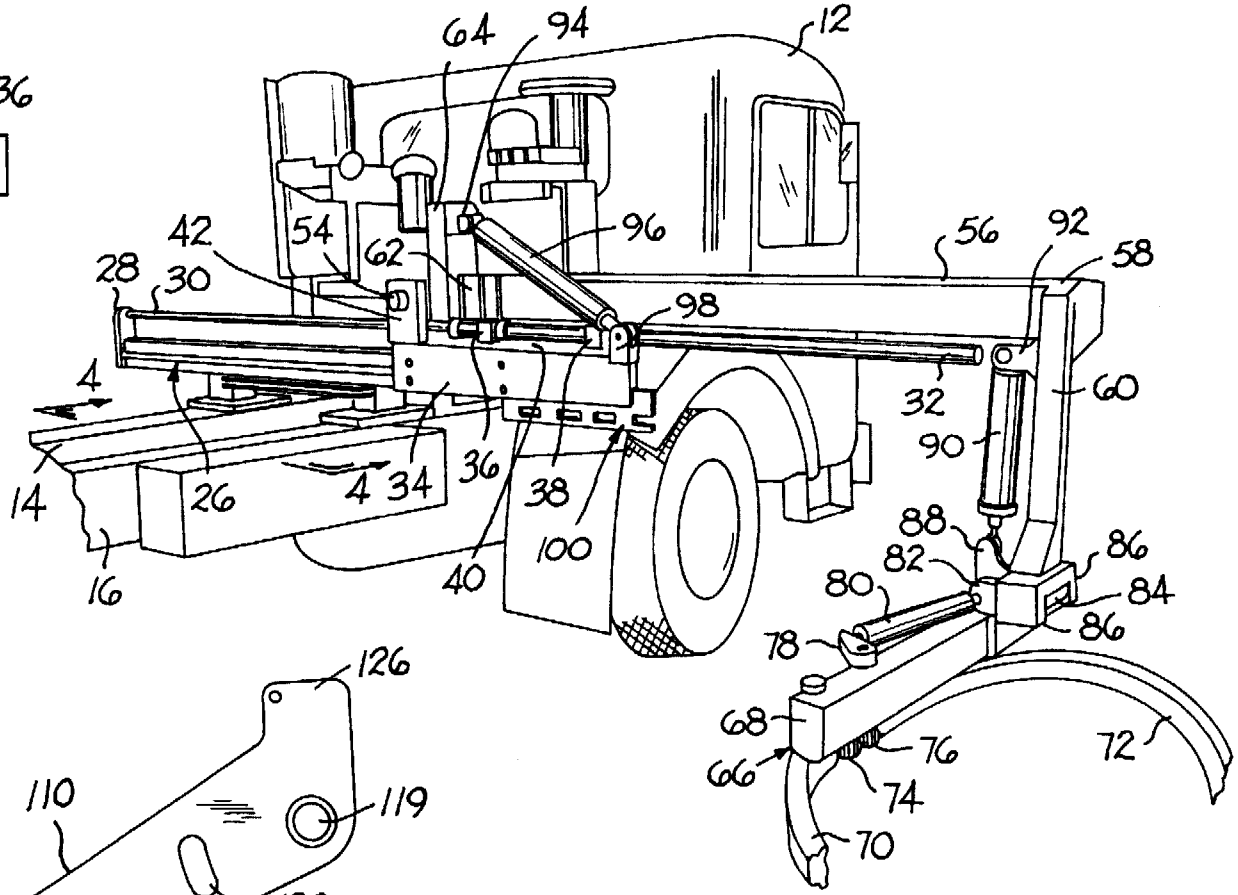
FIG. 2 is an enlarged fragmentary perspective view of the vehicle illustrated in FIG. 1, showing the side loading structure.

Referring now to the drawings, FIG. 1 illustrates a side loading refuse vehicle 10 conventionally having a cab 12 at the front, a chassis including longitudinally extending frame members 14, 16, illustrated in FIG. 2, and a refuse receiving body 18 mounted on the chassis spaced behind the cab. The body has a refuse receiving hopper 20 at the top adjacent the front end and refuse may be deposited into the body by side loading apparatus as hereinafter described through the hopper. The refuse is there compacted by conventional apparatus within the body and eventually expelled at the rear end, preferably by dumping, after the rear end 22 is hingedly opened and the body tilted by means of a hydraulic cylinder 24 at each side.

Figure 4:
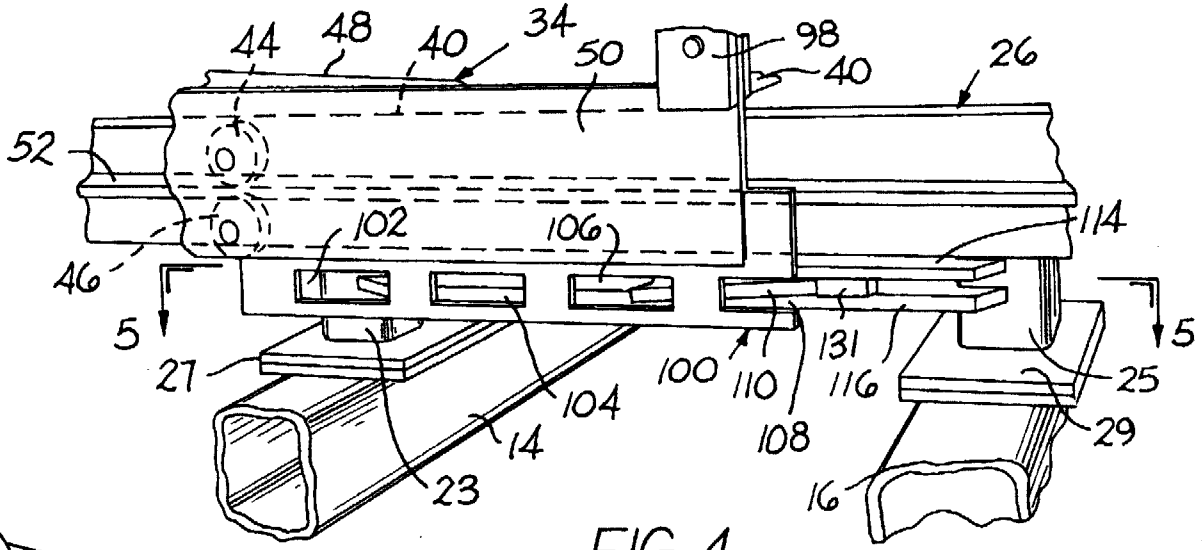
FIG. 4 is a fragmentary perspective view illustrating a portion of the apparatus illustrated in FIG. 3.
Figure 3:
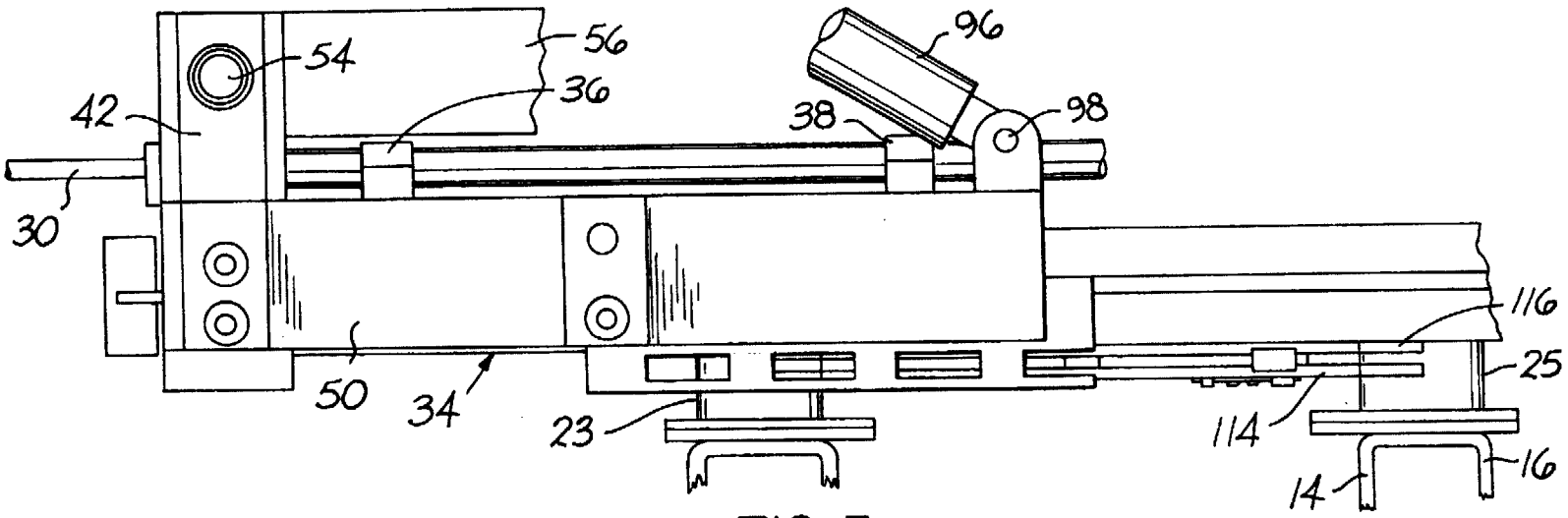
FIG. 3 is a fragmentary rear elevational view illustrating a portion of the side loading structure of FIG. 2, including the keeper plate of the present invention.

The side loading apparatus comprises a transversely extending track 26 extending between the sides adjacent the body intermediate the cab 12 and the body, the track, as best illustrated in FIGS. 3 and 4, being secured to and supported on stanchions 23, 25 secured on plates 27, 29 which are in turn secured to the frame members 14, 16. Fastened to the end of the track 26 at one side thereof, that side being the side remote from the sidewalk on which the refuse containers are located and thus the same side as that of the driver, is a small upstanding bracket 28 illustrated in FIG. 2. The bracket 28 secures and journally supports the end of a rod 30 extending from a hydraulic cylinder 32, the cylinder and rod defming an extension cylinder assembly. The cylinder 32 is secured to a carriage assembly 34 by means of a pair of spaced apart split blocks 36, 38 having the lower block being welded to a horizontal plate 40 on the carriage that is superposed above the rail and carries a number of rollers (not illustrated) disposed about vertical axes and which engage and roll against the respective front and rear surfaces of the track 26. The carriage assembly also includes a pair of spaced apart upstanding standards 42 welded thereto on opposite forward and rearward facing ends, only the rear standard being illustrated. Rollers, only a rear set 44, 46 being illustrated, are connected to front and rear vertical plates 48, 50 welded to the horizontal plate 40 of the carriage assembly and to both standards 42 and are disposed above and below a rail 52 protruding forwardly and rearwardly from the track 26 so that the rollers 44, 46 may ride on the rails. The carriage assembly is thus slidably mounted for riding on the track 26 and may be moved from side-to-side by means of the cylinder 32. Since the rod 30 of the hydraulic cylinder assembly is fixed against movement sidewise across the vehicle by the bracket 28, the cylinder 32 may be driven and thus the carriage assembly secured thereto.

Pivotally connected for rotation on a journal shaft 54 between the standards 42 is an elongated extendible lift arm 56. The arm 56 has a first off-set portion 58 with a downward extension 60 at its outer end and a second off-set portion 62 with an upward extension 64 at its other end, the off-sets being stepped rearwardly relative to the axis of elongation of the arm 56. The downwardly extending off-set portion 60 terminates in a drop arm assembly 66 which is connected to a rearwardly extending dump arm 68 which pivotally carries a pair of grabbers 70, 72 for clamping about a refuse container as illustrated in FIG. 1. The grabbers 70, 72 have sector gears 74, 76 secured on adjacent ends, the gears being in meshing relationship. The sector gear 76 has an off-set portion (not illustrated) which forms a lever for the sector gear 76 and a stud shaft connected to the off-set portion extends upwardly through the dump arm 68 and is secured to a lever arm 78. A hydraulic cylinder assembly 80 forming a grabber cylinder means is connected at one end to the arm 78 and at its other end to a lug 82. When the cylinder 80 is actuated the sector gear 76 is rotated and the grabbers move relative to each other to grasp or release a refuse container. The dump arm 68 is pivotally connected to the downward extension 60 of the lift arm 56 for rotation about the journal pin 84 disposed in off-set spaced apart blocks 86 secured to the dump arm 68, the pin 84 having an axis substantially parallel to the axis of elongation of the dump arm. A pair of spaced apart lugs 88 secured to the dump arm 68 extends in the opposite direction from the blocks 86 and one end of a hydraulic cylinder assembly 90 forming a dump cylinder means is pivotally connected between the lugs, the other end of the assembly 90 being connected between another pair of lugs 92 affixed to and extending inwardly relative to the downwardly extending off-set portion 60 of the lift arm 56. When the cylinder 90 is actuated, the dump arm assembly may be rotated relative to the pin 84 and thus the lift arm.

The upstanding extension 64 of the second off-set portion 62 of the lift arm 56 includes as pair of lugs 94 between which one end of a hydraulic cylinder assembly 96 forming a lift cylinder means is pivotally connected, the other end of the assembly 96 being pivotally connected between a pair of lugs 98 secured to the vertical plate 50 and the horizontal plate 40 of the carriage assembly 34. When the cylinder 96 is actuated to extend its piston, the lift arm assembly including the lift arm 56 and its downwardly extending portion 60 together with the dump arm assembly 66 may be pivoted about the journal shaft 54 relative to the carriage 34 so that a refuse container may be lifted over the hopper 20 and then the dump arm 68 may be pivoted- relative to the lift arm 56 to dump the contents of the refuse container into the hopper.

The structure thus far described is now conventional and has been described so as to define the environment of the present invention. The present invention, as aforesaid, relates to means for locking the arm 56 automatically in positions less than fully extended so that it may not extend further in the event of a failure in the drive cylinder assembly 30, 32, the hydraulic system associated therewith or the electrical system for controlling the hydraulic system.

To this end, the present invention provides a keeper in the form of a plate 100 secured as by welding to the rear plate 50 at the underside and leading edge of the carriage 34, the plate 100 being approximately ½ inch thick and approximately two feet long, the direction of elongation being substantially that of the arm 56.

Figure 6:
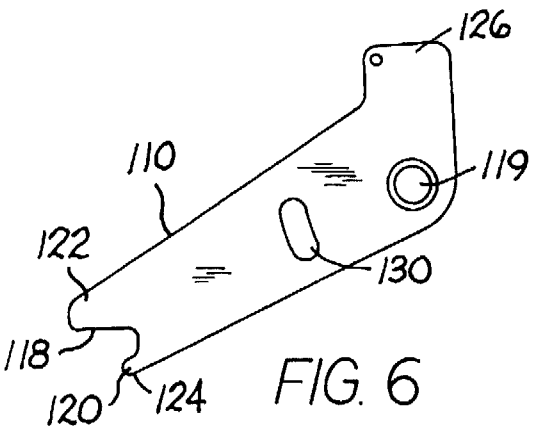
FIG. 6 is a top plan view of the latch detent.
Figure 5:
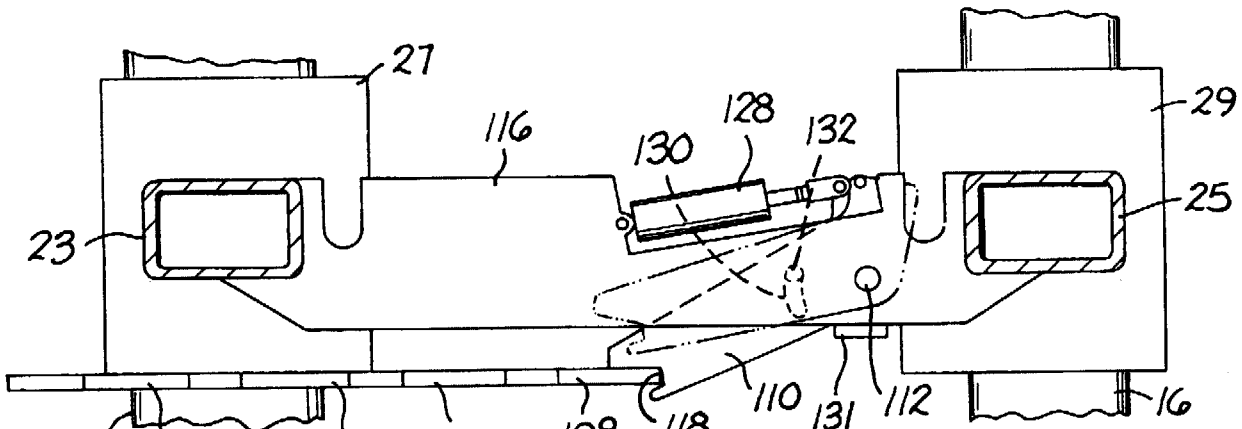
FIG. 5 is a horizontal cross sectional view taken substantially along line 5—5 of FIG. 4 illustrating the cooperation between the keeper plate and the detent latch.

Formed in the plate 100 is a plurality of slots, there preferably being three slots within the plate, 102, 104, 106, and a fourth slot 108 opening at the leading edge of the plate. A detent in the form of a latch 110 is pivotally connected by a journal pin 112 between a pair of plates 114, 116 which are secured below the track 28 to the stanchions 25. The latch 110, as illustrated in FIGS. 5 and 6, is a lever having a configuration including a hook 118 at one end spaced from the journal pin receiving hole 119 formed in the crotch between a pair of tines 120, 122 the surface 124 of the tine 120 externally of the crotch being smoothly contoured so as to form a cam-like surface as illustrated in FIG. 6. The latch 110 spaced from the hook 118, at the other side of the hole 119 has an arm 126 which is pivotally connected to one end of a small pneumatic cylinder assembly 128, the other end of the assembly 128 being pivotally connected to a pin extending between the plates 114, 116.

The cylinder assembly 128 has a piston which is spring loaded to the retracted position so that the latch 110 is disposed in the counter-clockwise pivoted position illustrated in FIG. 5, that position being such as to engage the hook with the plate 100 and thus the hook may enter into the slots 102, 104, 106, 108 selectively depending upon the sidewise location of the carriage 34. Thus, when the cylinder assembly is in the unactuated condition, the latch 110 seizes the plate 100 and is in the locking position. When the carriage 34 and thus the arm 56 is moving in the outwardly extending position, the latch 110 may lock with one of the slots since the keeper plate 100 at the trailing edge of the slot will enter between the tines 120, 122 of the hook 118. If the carriage is moving in the inward direction, the plate may ride over the smooth cam surface 124 and pivot the latch against the spring load on the piston of the cylinder assembly 128. However, it is preferred in such situations to actuate the cylinder assembly 128. When the cylinder assembly is actuated to extend the piston, the latch 110 is rotated in the clockwise direction to the short term position as illustrated in FIG. 5 and the latch is clear of the plate 100. This will occur only when the driver actuates the arm extension cylinder 32 to move the carriage 34 in either direction. The latch 110 may have a small arcuate slot 130 to limit pivotal movement of the latch in both directions and to aid in the assembly of the latch between the plates 114, 116, there being a small pin 132 fastened between the upper and lower plates which is received within the slot 130. Additionally a stop block 131 welded between the plates ensures that the latch will not pivot too far when in the latched position.

Figure 7:
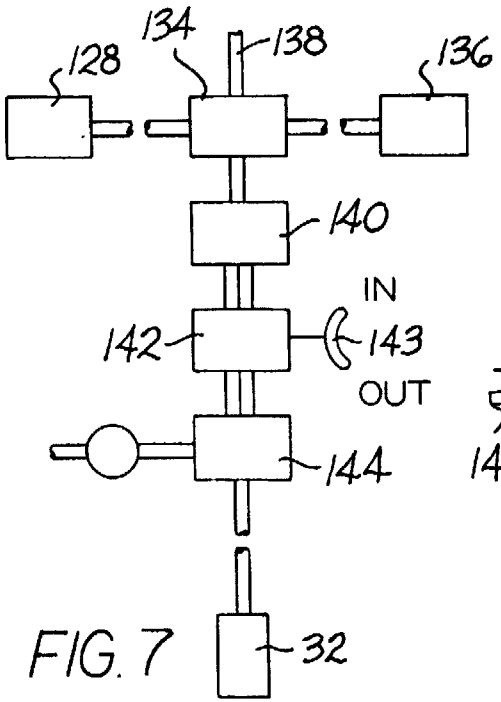
FIG. 7 is a diagrammatic view illustrating the manner in which the latch is controlled.

Associated with the pneumatic cylinder assembly 128, as illustrated in FIG. 7, is an air valve 134 receiving air from a source 136 conventionally within the vehicle 10, the valve having a vent 138 to exhaust the air back from the cylinder assembly 128 when the valve is closed. The air valve is connected electrically through a junction box 140 to a controller 142 for the hydraulic valving 144 controlling the arm extension cylinder assembly 32, the controller being operated by the driver via a rocker switch 143 which must be held in either the "in" or "out" position or is biased off. When the driver actuates the extension cylinder assembly 32 either in the inward or outward direction, the air valve 134 is also opened to actuate the pneumatic cylinder assembly 128 to pivot the latch 110 to the unlatched position.

Should a failure in the extension cylinder assembly occur, such as an electrical failure, the air valve will be precluded from operating and the carriage and arm will be locked by the latch 110. If a hydraulic failure or a cylinder drift failure occurs and if the arm is extended beyond approximately 32 inches, the driver will see it and can manually push the arm to a locked position. When the latch is within the slot 102, the arm is approximately 32 inches from the body of the vehicle. Locking in the other slots positions the arm less than 32 inches by approximately 6 inches per slot. If the failure occurs when the cylinder is less than approximately 32 inches from the body, the latch 110 will lock the carriage and thus the arm and if the extension cylinder assembly 32 is attempted to be actuated but doesn't, the operator will release the switch 143 and the carriage will remain locked. Thus, when the vehicle is cornering or being driven on the highway, the arm will be locked and cannot be thrown outwardly by centrifugal or gravitation forces. Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A side loading refuse collection vehicle including a longitudinally elongated frame, a body affixed to the frame for receiving refuse at a top portion thereof, a track extending transversely to said frame, a carriage slidably mounted on said track, a lift arm pivotably connected to said carriage and movable therewith for extending from one transverse side of said vehicle beyond said body, said left arm carrying refuse container grabber and dumping means for clamping about a refuse container and for dumping said container into said body, hydraulic drive means for slidably driving said carriage and said lift arm along said track selectively between an unextended and a fully extended position, and retaining means for locking said carriage and said left arm in selected positions close to said body than said fully extended position, said retaining means including a keeper secured to and movable with said carriage, a latch for seizing and holding said keeper to prevent said carriage from moving in the direction toward said fully extended position, and means for releasing said latch from said keeper selectively to permit said carriage and said left arm to move toward said fully extended position.

2. A side loading refuse collection vehicle as recited in claim 1, wherein said hydraulic drive means includes a hydraulic cylinder assembly and control means for actuating said hydraulic cylinder assembly to drive said carriage, and said means for releasing said latch includes a latch drive assembly connected to said latch for moving said latch, whenever said control means actuates said hydraulic cylinder assembly.

3. A side loading refuse collection vehicle as recited in claim 2, wherein said keeper comprises a plate having at least one slot, and said latch includes a pivotally mounted latch having a hook portion for entering into said at least one slot when said latch is pivoted in a first direction selectively, said hook being configured and disposed for seizing and holding said plate until said latch is pivoted in a second direction opposite to said first direction.

4. A side loading refuse collection vehicle as recited in claim 3, including latch drive means for pivotally driving said latch in said first and said second direction selectively.

5. A side loading refuse collection vehicle including a longitudinally elongated frame, a body affixed t6 the frame for receiving refuse at a top portion thereof, a track extending transversely to said frame, a carriage slidably mounted on said track, a lift arm pivotably connected to said carriage and moveable therewith for extending from one transverse side of said vehicle beyond said body, said left arm carrying refuse container grabber and dumping means for clamping about a refuse container and for dumping said container into said body, hydraulic drive means for slidably driving said carriage and said lift arm along said track selectively between art unextended and a fully extended position, and retaining means for locking said carriage and said left arm in selected positions closer to said body than said fully extended position, said retaining means including a keeper secured to and movable with said carriage, said keeper comprising a plate having at least one slot, a pivotally mounted latch having a hook portion for entering into said at least one slot when said latch is pivoted in a first direction selectively, said hook being configured and disposed for seizing and holding said plate when said hook is within said at least one slot to prevent said carriage from moving in the direction toward said fully extended position, and means for pivoting said latch in a direction opposite to said first direction for releasing said latch from said plate selectively to permit said carriage and said left arm to move toward said fully extended position.

6. A side loading refuse collection vehicle as recited in claim 5, including latch drive means for pivotally driving said latch in said first and said opposite direction selectively.

7. A side loading refuse collection vehicle as recited in claim 3, wherein said latch drive means includes a drive cylinder, means operably connecting said drive cylinder to said latch for pivoting said latch in said opposite direction when said drive cylinder is actuated, and said drive cylinder retaining said latch in said first direction when not actuated.

8. A side loading refuse collection vehicle as recited in claim 7, wherein said hydraulic drive means includes a hydraulic cylinder assembly and control means for actuating said hydraulic cylinder assembly to drive said carriage, and said means for releasing said latch includes a latch drive assembly connected to said latch for moving said latch whenever said control means actuates said hydraulic cylinder assembly.

9. A side loading refuse collection vehicle as recited in claim 8, wherein said control means includes operator activated switch means for actuating said hydraulic cylinder assembly to drive said carriage and said lift arm between said unextended and said fully extended positions selectively and for actuating said drive cylinder.

10. A side loading refuse collection vehicle as recited in claim 1, wherein said plate includes a plurality of slots spaced apart transversely, said hook being disposed for entering into any of said slots for seizing and holding said plate, whereby said carriage may be held in selected transversely spaced positions.

11. A side loading refuse collection vehicle as recited in claim 10, including latch drive means for pivotally driving said latch in said first and said opposite direction selectively.

12. A side loading refuse collection vehicle as recited in claim 11, wherein said latch drive means includes a drive cylinder, means operably connecting said drive cylinder to said latch for pivoting said latch in said opposite direction when said drive cylinder is actuated, and said drive cylinder retaining said latch in said first direction when not actuated.

13. A side loading refuse collection vehicle as recited in claim 12, wherein said hydraulic drive means includes a hydraulic cylinder assembly and control means for actuating said hydraulic cylinder assembly to drive said carriage, and said means for releasing said latch includes a latch drive assembly connected to said latch for moving said latch whenever said control means actuates said hydraulic cylinder assembly.

14. A side loading refuse collection vehicle as recited in claim 13, wherein said control means includes operator activated switch means for actuating said hydraulic cylinder assembly to drive said carriage and said lift arm between said unextended and said fully extended positions selectively and for activating said drive cylinder.

15. A side loading refuse collection vehicle as recited in claim 14, wherein said drive cylinder comprises a pneumatic cylinder assembly including a piston rod biased so as to position said latch in said first direction.

16. In a side loading refuse collection vehicle including a longitudinally elongated frame, a body carried by the frame for receiving refuse at a top portion thereof, a carriage movably mounted relative to said frame, a lift arm pivotably connected to said carriage and movable therewith for extending from one transverse side of said vehicle beyond said body, said left arm carrying refuse container grabber and dumping means for clamping about a refuse container and for dumping said container into said body, hydraulic drive means for moving said carriage and said lift arm selectively between an unextended and a fully extended position, and retaining means for locking said carriage and said left arm in selected positions closer to said body than said fully extended position, said retaining means including a keeper secured to and movable with said carriage, a latch for seizing and holding said keeper to prevent said carriage from moving in the direction toward said fully extended position, and means for releasing said latch from said keeper selectively to permit said carriage and said left arm to move toward said fully extended position.

* * * * *

UNITED STATES PATENT AND TRADEMARK OFFICE

CERTIFICATE OF CORRECTION

PATENT NO. : 5,755,547

DATED : May 26, 1998

INVENTOR(S) : Gary G. Flerchinger & Wayne C. Smith

It is certified that error appears in the above-indentified patent and that said Letters Patent is hereby corrected as shown below:

Column 6, line 17 change "left" to - - lift - -
Column 6, line 23 change "left" to - - lift - -
Column 6, line 24 change "close" to - - closer - -
Column 6, line 30 change "left" to - - lift - -
Column 6, line 57 change "left" to - - lift - -
Column 6, line 62 change "art" to - - an - -
Column 6, line 63 change "left" to - - lift - -
Column 7, line 9 change "left" to - - lift - -
Column 8, line 29 change "left" to - - lift - -
Column 8, line 35 change "left" to - - lift - -
Column 8, line 41 change "left" to - - lift - -

Signed and Sealed this

Eighteenth Day of August, 1998

Bruce Lehman

*Attest:*

BRUCE LEHMAN

*Attesting Officer*

*Commissioner of Patents and Trademarks*